US011813886B2

(12) United States Patent
Cheon

(10) Patent No.: US 11,813,886 B2
(45) Date of Patent: Nov. 14, 2023

(54) SLIDE-TYPE WRITING INSTRUMENT HAVING DRYING-PREVENTION DEVICE

(71) Applicant: Kwang Ju Cheon, Kyunggi-do (KR)

(72) Inventor: Kwang Ju Cheon, Kyunggi-do (KR)

( * ) Notice: Subject to any disclaimer, the term of this patent is extended or adjusted under 35 U.S.C. 154(b) by 0 days.

(21) Appl. No.: 18/073,743

(22) Filed: Dec. 2, 2022

(65) Prior Publication Data

US 2023/0311558 A1 Oct. 5, 2023

(30) Foreign Application Priority Data

Apr. 5, 2022 (KR) ..... 10-2022-0042015

(51) Int. Cl.

| | |
|---|---|
| ***B43K 23/12*** | (2006.01) |
| ***B43K 8/00*** | (2006.01) |
| ***B43K 8/02*** | (2006.01) |
| ***B43K 24/08*** | (2006.01) |

(52) U.S. Cl.

CPC ..... *B43K 23/12* (2013.01); *B43K 8/003* (2013.01); *B43K 8/028* (2013.01); *B43K 24/08* (2013.01)

(58) Field of Classification Search

CPC ..... B43K 8/003; B43K 8/028; B43K 23/12; B43K 24/08

See application file for complete search history.

(56) References Cited

U.S. PATENT DOCUMENTS

| | | | | |
|---|---|---|---|---|
| 4,629,348 | A * | 12/1986 | Hashimoto | B43K 8/24 401/107 |
| 7,465,112 | B2 * | 12/2008 | Qiu | B43K 8/028 401/99 |
| 7,850,382 | B2 * | 12/2010 | Hayes | B43K 24/08 251/298 |
| 10,434,815 | B2 * | 10/2019 | Cheon | B43K 24/08 |
| 2008/0138139 | A1 * | 6/2008 | Kageyama | B43K 8/028 401/107 |

FOREIGN PATENT DOCUMENTS

| | | |
|---|---|---|
| KR | 2019880002221 | 4/1988 |
| KR | 1019880006058 | 7/1988 |
| KR | 1014559580000 | 10/2014 |

* cited by examiner

*Primary Examiner* — David P Angwin
*Assistant Examiner* — Bradley S Oliver
(74) *Attorney, Agent, or Firm* — IPLA P.A.

(57) ABSTRACT

A slide-type writing instrument having a drying-prevention device includes: a pen housing (10); an ink holder (30) disposed in the pen housing (10); a sealing member (40) configured to prevent a drying phenomenon of ink on a pen tip (31); a spring (50) configured to effect elastic support between the sealing member (40) and the ink holder (30); a guide member (60) configured to guide the sealing member (40) when the ink holder (30) is advanced or retreated; and a cam protrusion (70) configured to be responsible for a guiding function of moving the guide member (60). The sealing member includes a soft tube formed of a soft material and a hard tube formed of a hard material and in the shape of a hollow tube to externally surround the soft tube, and the soft tube and the hard tube form a dual cross-section structure.

5 Claims, 11 Drawing Sheets

SLIDE-TYPE WRITING INSTRUMENT HAVING DRYING-PREVENTION DEVICE

BACKGROUND

The present invention relates to a slide-type writing instrument having a drying-prevention device, and more particularly, to a slide-type writing instrument having a drying-prevention device, wherein the sealing ability of a sealing member can be greatly improved to consistently prevent evaporation of ink or drying of a pen tip of the writing instrument using highly-volatile ink and the durability and reliability of the writing instrument can be improved by consistently maintaining an assembled state even when the sealing member having a dual structure is repeatedly pressed to cause an ink holder to protrude or be retreated.

In general, writing instruments refer to sign pens, highlighters, magic markers, felt pens such as Plus Pen™, or the like in addition to ballpoint pens, and most of them are provided with detachable sealing caps for preventing ink from being dried at pen tips of the writing instruments.

These writing instruments may be largely classified into a fixed-type writing instrument employing a fixed pen tip and a cap (hereinafter referred to as "lid"), a rotation-type (screw-type) writing instrument in which a portion of a pen tip is come out along a spiral pipe by partially rotating a shaft, a knock-type writing instrument in which a pen tip comes out by a movement of a spring in response to pressing of a portion of a shaft, and a slide-type writing instrument in which a pen tip is slid to come in and out.

A sealing member of the slide-type writing instrument has an advantage in that a user can use the writing instrument without any inconvenience related to opening and closing of a separate lid. However, this sealing member has a disadvantage that since a pen tip-passing hole through which a pen tip comes in and out is merely provided at a one end of the writing instrument, this sealing member is limitedly applicable only to writing instruments using non-volatile or low-volatile ink such as oil-based ink or the like.

On the contrary, when pen tips of marker pens, white pens, water-based pens, highlighters or the like using highly-volatile ink remain in air for a long time, ink or the like is dried, whereby the useful life of the writing instruments may be shortened or deteriorated. Therefore, although there is inconvenience in use, lids are opened and closed to use the writing instruments.

Accordingly, Korean Patent No. 10-1995-0000776 (Lidless writing instrument having drying-prevention device) discloses a configuration in which when a pressing portion of a slide-type writing instrument is pressed, a cover for covering a pen tip portion is opened, and when the pressing portion is pressed once again, the cover is closed and seals the writing instrument to prevent drying of ink.

In addition, Korean Utility Model Registration No. 20-1989-0003644 (Capless writing instrument) discloses a configuration in which when a knock portion is pressed, a pen tip breaks through an elastic body provided on an inner barrel and then is exposed to allow a pen to be used, and when the pen tip is returned to its original position by releasing or re-pressing the knock portion, incised portions of the elastic body are brought into contact with each other and then closed, thereby preventing the pen tip from being dried.

However, this configuration has problems in that the incised portions of the elastic body may be plastically deformed due to friction caused by frequent uses and a sealing force is also deteriorated due to frequent friction.

Meanwhile, an invention disclosed in Korean Patent No. 10-1455958 proposes a slide-type writing instrument having a drying-prevention device, wherein when a knob is pressed with a simpler manipulation, a cover portion for sealing a pen tip is opened so that the pen tip protrudes, whereas when the knob is released, the pen tip is retreated into an interior of the writing instrument and the cover portion is automatically closed to prevent the pen tip accommodated in the interior of the writing instrument from being dried.

For the drying-prevention function of such a writing instrument, the performance and durability of the sealing member that is opened or closed in response to an operation of causing the pen tip to come in or out and maintains airtightness in a state where the pent tip is accommodated inside are very critical.

However, the conventional sealing member of Korean Patent No. 10-1455958 is made from silicone or a soft synthetic resin material such that the cover hingedly connected to a leading end of the sealing member can be opened and closed. Therefore, at the beginning of use, there was no great problem in maintaining a sealing performance. However, there were disadvantages in that when the writing instrument is repeatedly used, a pressing force is lost at a position where the cover is in contact with a cylindrical body of the sealing member to maintain airtightness, and the sealing performance is thus gradually deteriorated.

SUMMARY OF THE INVENTION

It is an object of the present invention to provide a slide-type writing instrument having a drying-prevention device with a good sealing function.

It is an another object of the present invention to provide a slide-type writing instrument having a drying-prevention device, wherein it is possible to prevent loss of a sealing function or occurrence of a failure resulting from separation of a sealing member having a dual structure, which is caused by repeated uses.

It is a further object of the present invention to provide a slide-type writing instrument having a drying-prevention device, which can significantly improve the reliability and durability of a product.

In order to achieve the objects, the present invention further improves a sealing member for preventing drying of ink on a pen tip in a conventional slide-type writing instrument, and includes the improved sealing member.

In general, the conventional slide-type writing instrument having a drying-prevention device includes a pen housing formed in a hollow cylindrical shape and having a pen tip-passing hole formed at a leading end of the pen housing; an ink holder disposed in the pen housing and including a pen tip at a leading end of the ink holder; a sealing member configured to prevent a drying phenomenon of ink on the pen tip; a spring configured to effect elastic support between the sealing member and the ink holder; a guide member configured to guide the sealing member when the ink holder is advanced or retreated; and a cam protrusion configured to be responsible for a guiding function of moving the guide member.

The present invention further improves the sealing member. The sealing member may include a soft tube formed of a soft material and a hard tube formed of a hard material and in the shape of a hollow tube to externally surround the soft tube, and the soft tube and the hard tube may form a dual cross-section structure.

The sealing member may include a cover at a lower end of the sealing member, and the cover may have a sealing ring formed integrally with and protrudingly from the cover so as to be fitted into an inner circumference portion of the soft tube and to effect a sealing function.

It is preferable that a dimension of a largest diameter portion of the sealing ring is larger than that of an inner diameter of the soft tube.

The cover may be hingedly connected to a leading point of a lower end of the hard tube, and the cover may be positioned in a direction perpendicular to a central axis of the pen housing.

Here, the sealing ring may be formed to have a semicircular cross-section.

Moreover, a lower end of the soft tube may include a projection extending beyond the lower end of the hard tube by a protruding height t, and the projection may be formed to be brought into contact with the cover.

Furthermore, the soft tube may be formed of a soft rubber material and have fixing protrusions formed at an upper end of an outer surface of the soft tube so as to protrude outward in opposite directions, and the soft tube may be assembled with the hard tube by forcibly coupling the fixing protrusions into receiving grooves of fixing caps provided at an upper end of an outer surface of the hard tube.

A pressing ring may be formed integrally with and protrudingly from the guide member in the direction perpendicular to the axis along a circumference of an operating hole of the guide member so that the pressing ring presses a bottom of the cover in a sealing state of the cover.

DETAILED DESCRIPTION OF THE INVENTION

Figure 1:
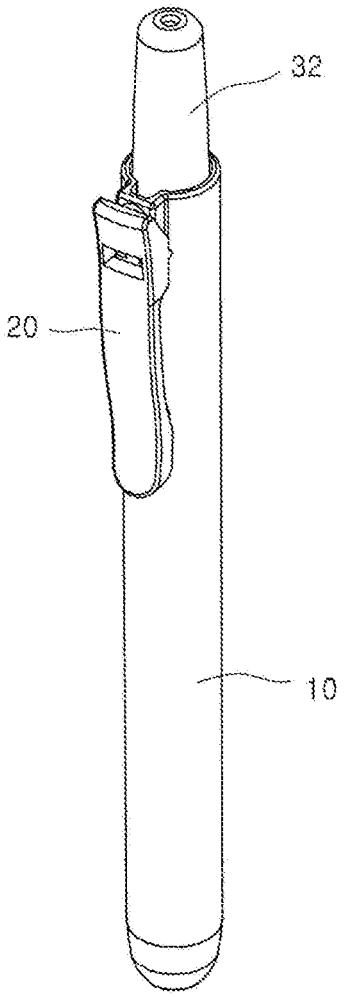
FIG. 1 is a perspective view showing a state where a pen tip of a writing instrument according to the present invention is stored in a pen housing of the writing instrument and thus maintained in an airtight condition.
Figure 2:
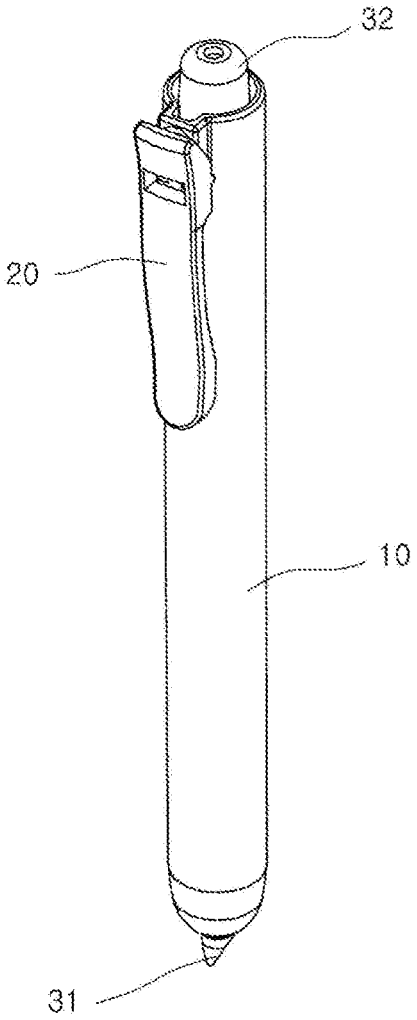
FIG. 2 is a perspective view showing a state where the pen tip of the writing instrument according to the present invention is exposed.
Figure 3:
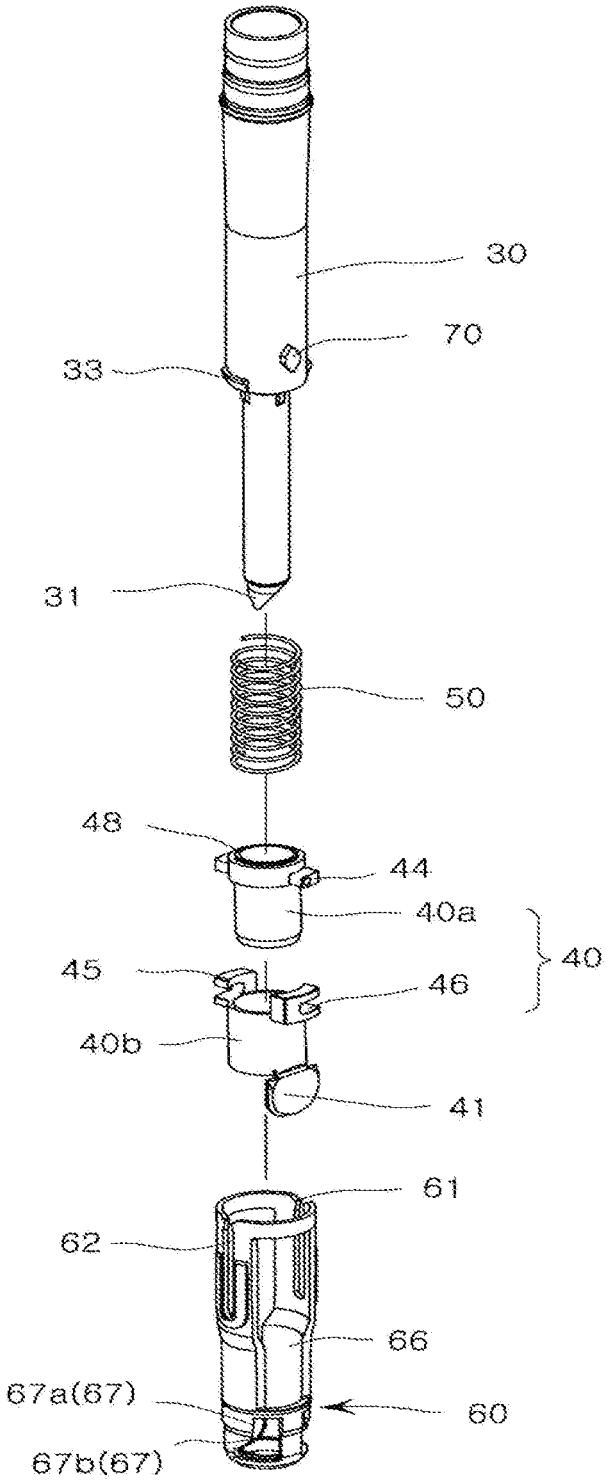
FIG. 3 is an exploded perspective view showing a configuration of the writing instrument according to the present invention.
Figure 4:
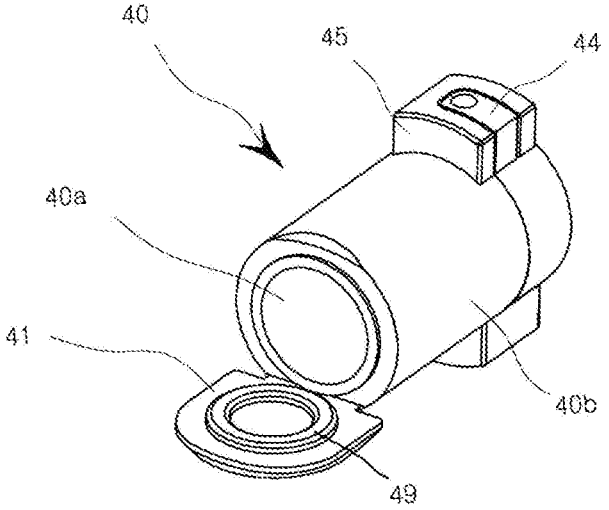
FIG. 4 is a perspective view showing an assembled state of a sealing member of the writing instrument according to the present invention.
Figure 5:
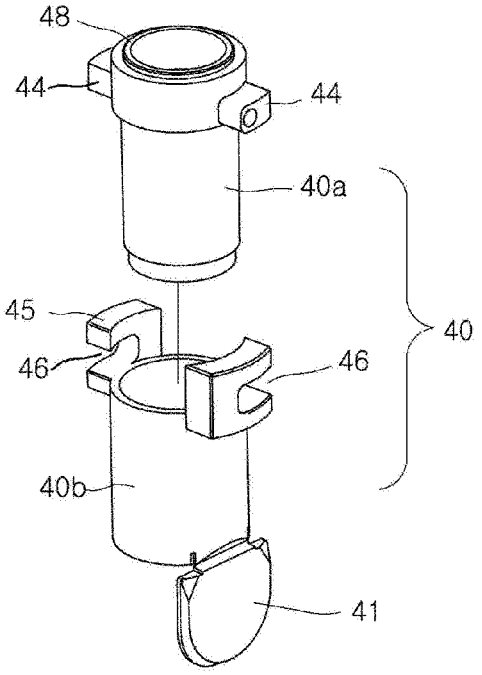
FIG. 5 is a perspective view showing a disassembled state of the sealing member of the writing instrument according to the present invention.

Advantages and features of the present invention, and methods for achieving them will be apparent from reference to an embodiment described in detail below together with the accompanying drawings.

However, the present invention is not limited to the embodiment disclosed below but may be implemented in a variety of different forms. The embodiment is provided merely to make the disclosure of the present invention perfect and to fully inform those skilled in the art of the scope of the invention. The present invention is defined only by the scope of appended claims.

The terms used herein are intended to describe the embodiment, and not to limit the present invention. Herein, singular forms in phrases include plural forms unless particularly stated otherwise. The terms used herein "comprises" and/or "comprising" do not exclude presence or addition of other components in addition to stated components.

Unless defined otherwise herein, all terms used herein (including technical and scientific terminology) could be used as meanings which can be understood commonly by those skilled in the art.

Hereinafter, a preferred embodiment of the present invention will be described in detail with reference to the accompanying drawings.

A slide-type writing instrument having a drying-prevention device according to the present invention is to further improve a conventional sealing member. A sealing member of the slide-type writing instrument having the drying-prevention device according to the present invention is configured to enable a pen tip of a writing instrument using highly-volatile ink, for example, a highlighter, a magic marker, a sign pen, a felt pen such as Plus Pen™, or the like, to protrude to the outside only in use, and to be hermetically accommodated in a pen housing of the writing instrument in non-use, thereby preventing evaporation of the ink and drying of the pen tip.

The present invention is to further improve a sealing member in a conventional slide-type writing instrument. The conventional slide-type writing instrument includes a pen housing 10 having a hollow cylindrical shape and having a pen tip-passing hole 11 formed therethrough at a leading end thereof. The pen housing 10 is provided with an ink holder 30 and a sealing member 40 having a drying-prevention function, which are accommodated in the pen housing 10, and has a button clip part 20 provided outside of the pen housing 10. An ink injection-type ink holder that can be repeatedly used by injecting ink thereinto or an ink exchange-type ink holder may be employed as the ink holder 30.

A pen tip 31 of the ink holder 30 can be exposed through the pen tip-passing hole 11 formed at the leading end of the pen housing 10.

Further, the pen housing 10 has the button clip part 20 provided at an upper portion outside of the pen housing 10, whereby a lock/unlock device for allowing the ink holder 30 to be kept in a forward movement state and/or a backward movement state may be activated by a click operation on the button clip part 20.

In addition, a lock mechanism that is switched to a locked state by pressing a knob 32 of the ink holder 30, which is exposed beyond an upper end of the pen housing 10, once and to an unlocked state by subsequently pressing the knob again may be provided. This lock mechanism has been already known in the art.

The pen tip 31 is coupled to a leading end of the ink holder 30 accommodated in the pen housing 10, and the knob 32 is detachably provided at the other end of the ink holder such that an interior of the pen housing may be filled with ink or ink may be exchanged.

The sealing member 40 is installed at the leading end of the ink holder 30, wherein the pen tip 31 may come in or out via this sealing member. The sealing member 40 has a sealing function for preventing drying of ink in a state where the pen tip 31 is accommodated in the pen housing in non-use.

A cover 41 made of a synthetic resin material is hingedly connected to a leading end of the sealing member 40, and the cover 41 is maintained in a state where the cover is opened in parallel with a central axis of a body of the writing instrument so as not to hinder the pen tip 31 from coming in or out in a natural state.

The cover 41 is fitted into a cam slit 67 of a guide member 60 so that a sealing operation of the cover is controlled by forward and backward operations of the guide member 60.

The guide member 60 is made of a synthetic resin material and formed in a hollow cylindrical shape, and is provided between the sealing member 40 and the pen housing 10.

Accordingly, when the ink holder 30 is moved forward or backward in a state where the sealing member 40 is accommodated in the guide member 60, the guide member 60 is simultaneously moved to cause the cover 41 to be guided along the cam slit 67 and thereby to guide an opening or closing operation of the cover 41.

Further, the guide member 60 has engagement portions 61 and a movement slit 62 provided longitudinally on a side of the guide member 60 by means of cutting, and an operating hole 65 is provided at a leading end of the guide member so that the pen tip 31 may be moved therethrough.

The ink holder 30 has a cam protrusion 70 integrally formed therewith and protruding therefrom. The cam protrusion 70 causes the guide member 60 to be moved while the cam protrusion is in contact with the engagement portions 61 of the guide member 60, and moves along the movement slit 62.

Therefore, in response to forward or rearward operations of the ink holder 30 and the guide member 60 in a state where the pen tip 31 is accommodated, the cover 41 hingedly connected to the leading end of the sealing member is opened, so that the pen tip 31 may come in or out.

Figure 8:
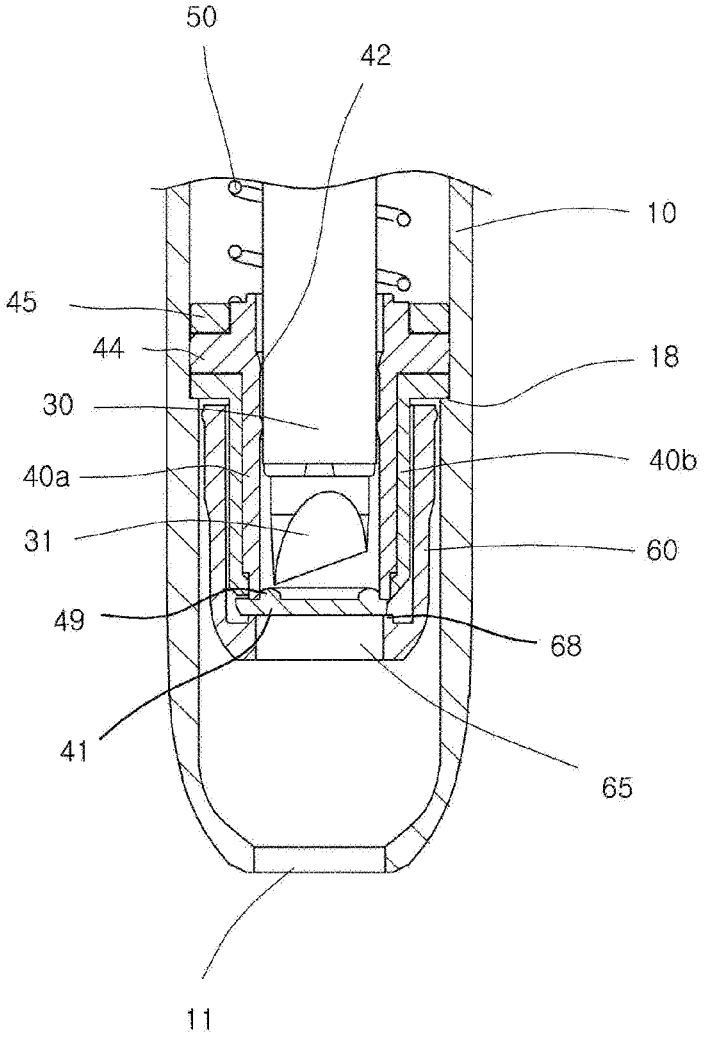
FIG. 8 is an enlarged sectional, partial view showing a state where the pen tip of the writing instrument is stored in the pen housing and maintained in the airtight condition.
Figure 9:
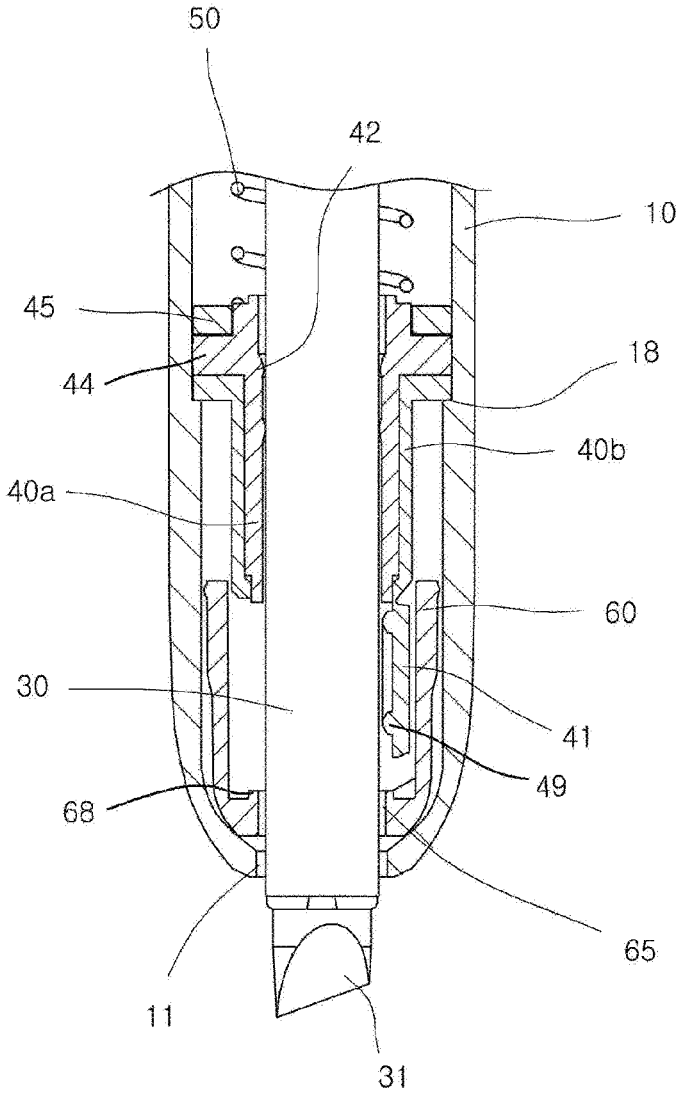
FIG. 9 is an enlarged sectional, partial view showing a state where the pen tip of the writing instrument is exposed.

A spring 50 is elastically provided between a spring-fixing ring 48 of the sealing member 40 and the ink holder 30. Therefore, when the cover 41 of the sealing member 40 is closed again in a state where the cover 41 has been opened, the cam slit 67 restrains the position of the cover 41 by a retreat of the guide member 60, so that the cover is pulled and closed to enable airtightness around the pen tip 31 to be maintained, as shown in FIG. 8.

At this time, the ink holder 30 is retreated together with the guide member 60, and the cover 41 of which position is controlled in the cam slit 67 is elastically supported by an elastic force of the spring 50 provided between the spring-fixing ring 48 and the ink holder 30, such that the cover 41 can be maintained to be in close contact with the leading end of the sealing member 40.

Figure 6:
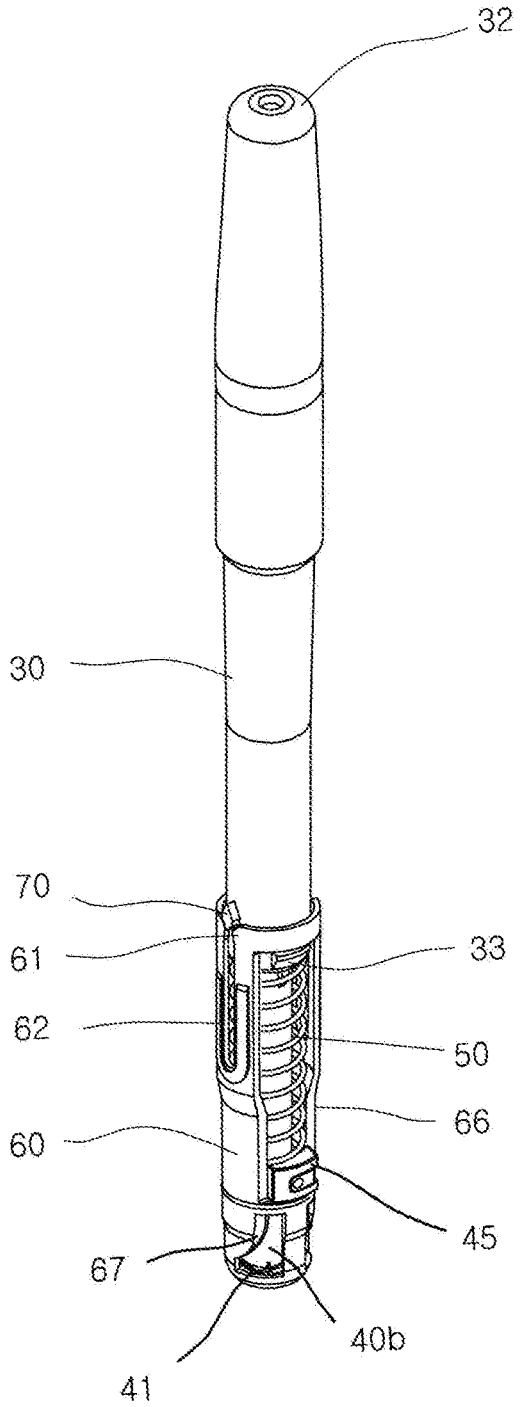
FIG. 6 is a perspective view showing an interior of the pen housing in a state where the pen tip of the writing instrument is stored therein and maintained in the airtight condition.
Figure 7:
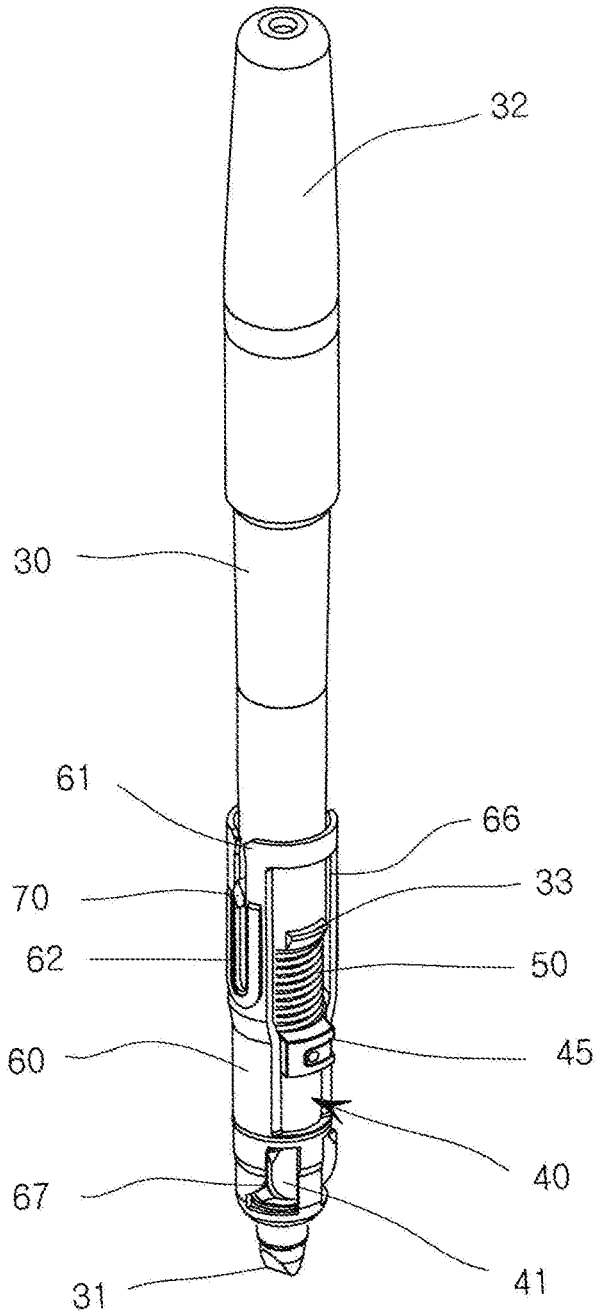
FIG. 7 is a perspective view showing the interior of the pen housing in a state where the pen tip of the writing instrument is exposed to the outside.

Further, the elongated movement slit 62 is longitudinally formed on one side or each of both sides of the guide member 60 as shown in FIGS. 6 and 7. The engagement portions 61 are formed at an entrance of the movement slit 62 in a manner of narrowing a passage of the movement slit 62.

The cam protrusion 70 is formed integrally with and protrudingly from the ink holder 30 at a location where the cam protrusion can be brought into contact with the engagement portions 61. In carried and stored states of the writing instrument where the writing instrument is not in use while the ink holder 30 is accommodated in the pen housing, the pen tip 31 has been retreated by the elastic force of the spring 50 to a state where the pen tip is covered with the cover 41 and maintained in an airtight condition within the sealing member 40 (see FIG. 8).

Meanwhile, the sealing member 40 includes an inner soft tube 40*a* and an outer hard tube 40*b* fitted over the soft tube 40*a* to externally surround the soft tube 40*b*. The soft tube 40*a* and the hard tube 40*b* form a dual cross-section structure.

At this time, it is preferable that the soft tube 40*a* is made of a soft rubber material having good elasticity, an inner circumference portion of the soft tube 40*a* is formed with a sealing portion 42 which protrudes inward and is to be brought into close contact with an outer circumference portion of the ink holder 30, and fixing protrusions 44 are formed at an upper end of an outer surface of the soft tube so as to protrude outward in opposite directions.

It is preferable that the hard tube 40*b* is made of a hard synthetic resin material and formed with protruding fixing caps 45 having concave receiving grooves 46 at an upper end of an outer surface of the hard tube.

It is preferable that the receiving grooves 46 and the fixing protrusions 44 are formed perpendicularly to a central axis of the sealing member 40, respectively and the soft fixing protrusions 44 are formed to have dimensions smaller than those of the receiving grooves 46 in a tolerance range, so that the fixing protrusions 44 are forcibly assembled with and coupled to the receiving grooves 46 by fitting the soft tube 40*a* into the hard tube 40*b* and rotating the soft tube 40*a* therein.

At this time, dimensions of an outer diameter of the soft tube 40*a* and an inner diameter of the hard tube 40*b* are designed such that it is possible to maintain an integrated feeling of these tubes in an assembled state without being loosened.

Particularly, since the assembly is made by means of rotation of the receiving grooves 46 in a direction perpendicular to the axis so as to receive the fixing protrusions 44, it is possible to prevent the soft tube 40*a* from being pushed away or failing and accordingly loss of the sealing function even though the ink holder 30 and the guide member 60 are repeatedly operated or subjected to impact in a vertical direction.

The cover 41 made of a synthetic resin material is hingedly connected to the hard tube 40*b* at the lower leading end of the hard tube and is also formed with a sealing ring 49 integrally with the cover 41 to be fitted into an inner circumference portion of the soft tube 40*a* and to effect the sealing function.

The sealing ring 49 is formed to have a semicircular cross-section and the dimension of a largest diameter portion of the sealing ring 49 is larger than that of an inner diameter of the soft tube 40*a*.

A lower end of the soft tube 40*a* further extends beyond a lower end of the hard tube 40*b* by a protruding height t so as to form a projection 47 which is to be brought into contact with the cover 41.

The protruding height t of the projection 47 is suitably about 0.2 mm.

Figure 14:
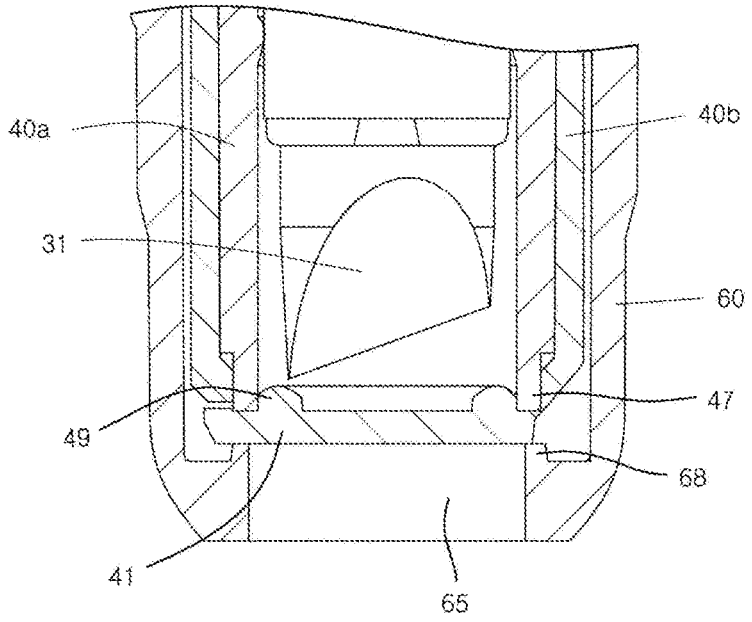
FIG. 14 is an enlarged view of a main portion of FIG. 8.

Therefore, the cover 41 formed integrally with the hard tube 40*b* is pressed more strongly against and in contact with the projection 47 of the soft tube 40*a* in a state where the pen tip 31 is accommodated in the sealing member 40, and at the same time, the sealing ring 49 is press-fit into an inner circumference portion of the projection 47 of the soft tube 40*a*, thereby enabling a more complete sealing state to be maintained (see FIG. 14).

Moreover, it is possible to achieve a good sealing function without concern about wear or deformation and to greatly extend a sealing life of the sealing member.

A plurality of sealing portions 42 are formed to protrude within the soft tube 40*a* so as to achieve close contact with the outer circumference portion of the ink holder 30.

Lower end faces of the soft tube 40*a* and the hard tube 40 are formed in a direction perpendicular to the central axis of the pen housing 10, respectively, and the cover 41 hingedly connected to the leading end of the hard tube 40*b* is positioned in the direction perpendicular to the axis in the sealing state of the cover.

A pressing ring 68 is formed integrally with the guide member 60 inside a lower end of the guide member along a circumference of the operating hole 65 so that the pressing ring 68 presses a bottom of the cover 41 in the sealing state of the cover 41 (see FIG. 14).

Therefore, the cover 41 of the sealing member 40 maintains the sealing state in the direction perpendicular to the axis by means of the interaction of the guide member 60 and the spring 50. At this time, since the pressing ring 68 formed to protrude inwardly from the lower end of the guide member 60 presses the bottom of the cover 41, it is possible to further improve the sealing effect provided by the cover 41.

When the writing instrument is intended to be used while exposing the pen tip 31 out of the leading end of the pen housing 10, the knob 32 is clicked to advance the ink holder 30 together with the sealing member 40. In order to maintain the exposed state of the pen tip, the ink holder is secured at a certain home position (not shown) of the button clip part 20.

Figure 10:
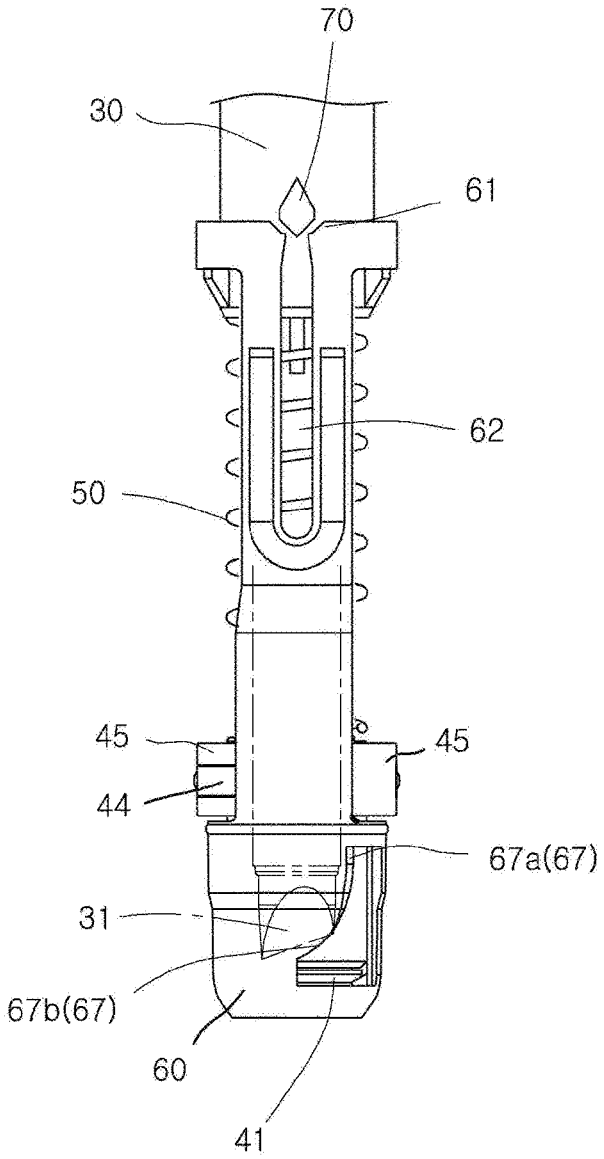
FIG. 10 is a front view of a main portion of the writing instrument, showing a state where a cam protrusion formed on an ink holder is brought into contact with engagement portions of a guide member and then pushed to be moved.

At this time, the cam protrusion 70 protruding outwardly from the ink holder 30 is brought into contact with the engagement portions 61 of the guide member 60 as shown in FIG. 10 and then maximally pushes and moves the guide member 60 to such an extent that the guide member 60 is movable, i.e., by a distance for bringing the guide member 60 into contact with an inside of the leading end of the pen housing 10.

Furthermore, since the fixing caps 45 formed in the sealing member 40 are caught on a stepped portion 18 formed on an inner side of the pen housing 10, the body of the sealing member 40 is not moved, whereas the cover 41 hingedly connected to the leading end of the sealing member 40 is opened or closed according to the position of the cam slit 67 of the guide member 60.

The cam slit 67 is formed to include a linear section 67*a* parallel to a movement direction of the ink holder 30, and a gently curved section 67*b* extending from the linear section 67*a* and causing the cover 41 to be in close contact with the leading end of the sealing member 40.

Figure 11:
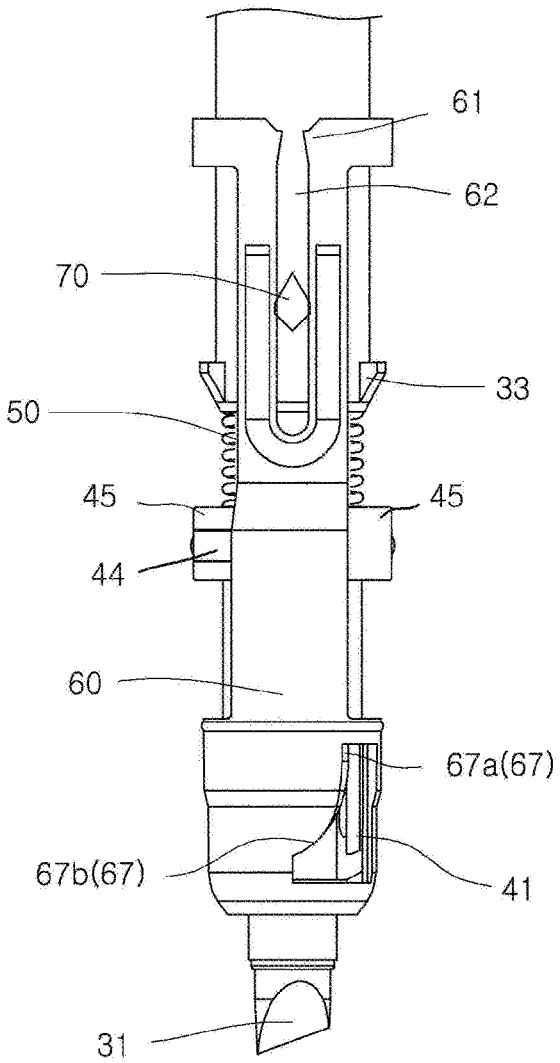
FIG. 11 is a front view of the main portion of the writing instrument, showing a state where the cam protrusion formed on the ink holder has entered a movement slit of the guide member and is then moved.
Figure 12:
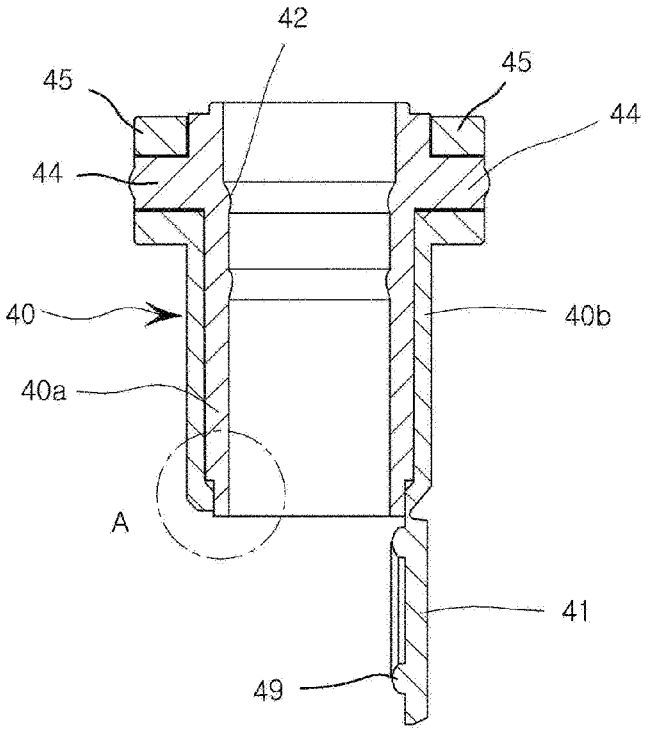
FIG. 12 is a sectional view of the sealing member.
Figure 13:
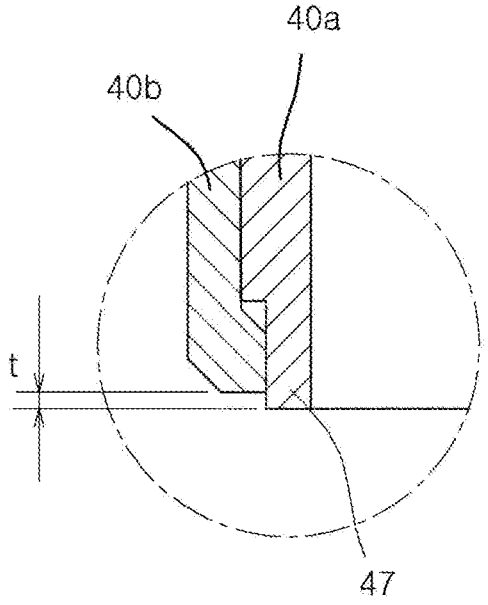
FIG. 13 is an enlarged sectional view of portion A in FIG. 12.

Therefore, when the guide member 60 is moved to a position where the guide member is in contact with an inner side of the leading end of the pen housing 10 and thus is no longer movable, the cover 41 is opened at the leading end of the sealing member 40 as a result of the movement of the cover 41 from the position of the curved section 67*b* of the cam slit 67 to the position of the linear section 67*a* (see FIG. 11).

At this time, a space between the engagement portions 61 with which the cam protrusion 70 has been in contact is widened by self-elasticity in response to the advancing movement of the ink holder 30 and the cam protrusion 70 then enters the movement slit 62. Accordingly, the pen tip 31 and the ink holder 30 are continuously further advanced so that the pen tip 31 may be exposed and then used for writing (see FIGS. 2, 7, 9 and 11).

Meanwhile, when the pen tip 31 is intended to be accommodated in the pen housing 10 and to be kept in the airtight condition, the button clip part 20 or the knob 32 is clicked so that the lock mechanism is operated to be switched to the unlocked state, whereby the ink holder 30 and the pen tip 31 are retreated due to the elastic force of the spring 50.

Then, as the guide member 60 is retreated backward, the cover 41 positioned in the linear section 67*a* of the cam slit 67 is guided to the position of the curved section 67*b*. In response to a further continuous retreat of the guide member 60, the pen tip 31 completely enters the pen housing 10 and the cover 41 is closed within the sealing member 40 to keep the airtight condition, as shown in FIG. 8.

Here, the cam protrusion 70 is retreated along the movement slit 62 and then widens the space between the engagement portions 61 again at a position where the guide member 60 is caught on the sealing member 40 and can be no longer retreated. Accordingly, the cam protrusion is slightly further retreated and placed in an initial state.

An engaging protuberance 33 is formed protrudingly from the ink holder 30 and an operation slit 66 is formed in the guide member 60 at a position corresponding to the engaging protuberance 33, so that the ink holder 30 and the guide member 60 may be assembled inseparably from each other and moved together upon retreat of the ink holder.

With this operation, the pen tip 31 is exposed to be usable for writing, or is accommodated in the sealing member 40 of the pen housing 10 and kept in the airtight condition to prevent evaporation of the ink or drying of the pen tip 31.

Particularly, the sealing portion 42 of the sealing member 40 for performing the function of preventing drying of the pen tip 31 can cause the hard cover 41 to be brought into contact with the soft tube 40*a* and the sealing ring 49 can be press-fit into the inner circumference portion of the projection 47, thereby more firmly preventing drying of the pen tip.

In addition, it is possible to prevent loss of the sealing function or occurrence of a failure caused by repeated uses, thereby greatly enhancing the reliability and durability of the product.

According to the present invention, the sealing ring made of a hard material and formed integrally with the cover of the sealing member can be brought into close contact with the soft tube, thereby greatly enhancing the sealing effect.

Furthermore, since the hard tube and the soft tube are coupled to each other in a horizontal direction via the fixing protrusions, it is possible to prevent loss of the sealing function due to a shift of the soft tube or occurrence of a failure due to separation of parts even though the ink holder and the guide member are repeatedly operated in a vertical direction.

Therefore, since the present invention can more firmly prevent the drying of the pen tip, there are advantages that the superiority and durability of the sealing function of the product are greatly enhanced.

The present invention is not limited by the aforementioned embodiment and the accompanying drawings, and it will be apparent to those skilled in the art that various substitutions, changes and modifications may be made without departing from the spirit and scope of the invention.

What is claimed is:

1. A slide-type writing instrument having a drying-prevention device, comprising a pen housing (10) formed in a hollow cylindrical shape and having a pen tip-passing hole (11) formed at a leading end of the pen housing; an ink holder (30) disposed in the pen housing (10) and comprising a pen tip (31) at a leading end of the ink holder; a sealing member (40) configured to prevent a drying phenomenon of ink on the pen tip (31); a spring (50) configured to effect elastic support between the sealing member (40) and the ink holder (30); a guide member (60) configured to guide the sealing member (40) when the ink holder (30) is advanced or retreated; and a cam protrusion (70) configured to be responsible for a guiding function of moving the guide member (60), wherein the sealing member (40) comprises a soft tube (40*a*) formed of a soft material and a hard tube (40*b*) formed of a hard material and in the shape of a hollow tube to externally surround the soft tube (40*a*), and the soft tube (40*a*) and the hard tube (40*b*) form a dual cross-section structure;

wherein the sealing member (40) comprises a cover (41) at a lower end of the sealing member, and the cover (41) has a sealing ring (49) formed integrally with and protrudingly from the cover (41) so as to be fitted into an inner circumference portion of the soft tube (40*a*) and to effect a sealing function;

wherein a dimension of a largest diameter portion of the sealing ring (49) is larger than that of an inner diameter of the soft tube (40*a*); and wherein the cover (41) is hingedly connected to a leading point of a lower end of the hard tube (40*b*), and the cover (41) is positioned in a direction perpendicular to a central axis of the pen housing (10).

2. The slide-type writing instrument of claim 1, wherein the sealing ring (49) is formed to have a semicircular cross-section.

3. The slide-type writing instrument of claim 1, wherein a lower end of the soft tube (40*a*) comprises a projection (47) extending beyond the lower end of the hard tube (40*b*) by a protruding height (t), and the projection (47) is formed to be brought into contact with the cover (41).

4. The slide-type writing instrument of claim 1, wherein the soft tube (40*a*) is formed of a soft rubber material and has fixing protrusions (44) formed at an upper end of an outer surface of the soft tube (40*a*) so as to protrude outward in opposite directions, and the soft tube (40*a*) is assembled with the hard tube (40*b*) by forcibly coupling the fixing protrusions (44) into receiving grooves (46) of fixing caps (45) provided at an upper end of an outer surface of the hard tube (40*b*).

5. The slide-type writing instrument of claim 1, wherein a pressing ring (68) is formed integrally with and protrudingly from the guide member (60) in the direction perpendicular to the axis along a circumference of an operating hole (65) of the guide member (60) so that the pressing ring (68) presses a bottom of the cover (41) in a sealing state of the cover (41).

* * * * *